US009973848B2

(12) United States Patent
Chhetri et al.

(10) Patent No.: US 9,973,848 B2
(45) Date of Patent: May 15, 2018

(54) SIGNAL-ENHANCING BEAMFORMING IN AN AUGMENTED REALITY ENVIRONMENT

(75) Inventors: Amit S. Chhetri, Sunnyvale, CA (US); Kavitha Velusamy, San Jose, CA (US); Edward Dietz Crump, Santa Cruz, CA (US)

(73) Assignee: Amazon Technologies, Inc., Seattle, WA (US)

( * ) Notice: Subject to any disclaimer, the term of this patent is extended or adjusted under 35 U.S.C. 154(b) by 519 days.

(21) Appl. No.: 13/165,620

(22) Filed: Jun. 21, 2011

(65) Prior Publication Data

US 2012/0327115 A1 Dec. 27, 2012

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2201/403* (2013.01); *H04R 2430/20* (2013.01); *H04R 2430/21* (2013.01)

(58) Field of Classification Search
CPC ..... H04R 3/005; H04R 2430/21; H04R 2201/401; H04R 2430/23; H04R 2430/20; H04R 1/406; H04R 2201/403
USPC ..... 381/92, 2, 77, 81, 82, 85; 345/633, 632, 345/629, 619; 700/94; 349/5; 352/104, 352/138, 25, 133, 11
See application file for complete search history.

(56) References Cited

U.S. PATENT DOCUMENTS

| | | | | |
|---|---|---|---|---|
| 7,418,392 | B1 | 8/2008 | Mozer et al. | |
| 7,720,683 | B1 | 5/2010 | Vermeulen et al. | |
| 7,774,204 | B2 | 8/2010 | Mozer et al. | |
| 2002/0131580 | A1* | 9/2002 | Smith | 379/387.01 |
| 2003/0063759 | A1* | 4/2003 | Brennan et al. | 381/92 |
| 2003/0161485 | A1* | 8/2003 | Smith | 381/92 |
| 2005/0195988 | A1* | 9/2005 | Tashev et al. | 381/92 |

(Continued)

FOREIGN PATENT DOCUMENTS

| | | |
|---|---|---|
| CN | 1565144 | 1/2005 |
| CN | 1746615 | 3/2006 |

(Continued)

OTHER PUBLICATIONS

M. Collobert, R. Ferraud, G. Le Tourneur, O. Bernier, J. E. Viallet, Y. Mahieux, D. Collobert, "Listen: A System for Locating and Tracking Individual Speakers", France Telecom, IEEE Transactions (1999).*

(Continued)

*Primary Examiner* — Vivian Chin
*Assistant Examiner* — Con P Tran
(74) *Attorney, Agent, or Firm* — Lee & Hayes, PLLC

(57) ABSTRACT

An augmented reality environment allows interaction between virtual and real objects. Beamforming techniques are applied to signals acquired by an array of microphones to allow for simultaneous spatial tracking and signal acquisition from multiple users. Localization information such as from other sensors in the environment may be used to select a particular set of beamformer coefficients and resulting beampattern focused on a signal source. Alternately, a series of beampatterns may be used iteratively to localize the signal source in a computationally efficient fashion. The beamformer coefficients may be pre-computed.

24 Claims, 14 Drawing Sheets

(56) References Cited

U.S. PATENT DOCUMENTS

| | | | | |
|---|---|---|---|---|
| 2005/0201204 | A1* | 9/2005 | Dedieu et al. | 367/118 |
| 2006/0210096 | A1* | 9/2006 | Stokes et al. | 381/107 |
| 2006/0239471 | A1 | 10/2006 | Mao et al. | |
| 2006/0262943 | A1* | 11/2006 | Oxford | 381/92 |
| 2007/0123110 | A1* | 5/2007 | Schwartz | 439/638 |
| 2008/0199024 | A1* | 8/2008 | Nakadai et al. | 381/92 |
| 2009/0028347 | A1* | 1/2009 | Duraiswami et al. | 381/26 |
| 2009/0086993 | A1* | 4/2009 | Kawaguchi et al. | 381/92 |
| 2009/0220065 | A1* | 9/2009 | Ahuja | H04M 3/569 379/202.01 |
| 2010/0026780 | A1* | 2/2010 | Tico et al. | 348/14.02 |
| 2011/0038486 | A1 | 2/2011 | Beaucoup | |
| 2011/0164141 | A1* | 7/2011 | Tico et al. | 348/207.99 |
| 2011/0184735 | A1* | 7/2011 | Flaks et al. | 704/240 |
| 2011/0317041 | A1* | 12/2011 | Zurek et al. | 348/240.99 |
| 2012/0120218 | A1* | 5/2012 | Flaks et al. | 348/77 |
| 2012/0124602 | A1* | 5/2012 | Tan et al. | 725/9 |
| 2012/0223885 | A1* | 9/2012 | Perez | 345/158 |
| 2014/0064514 | A1* | 3/2014 | Mikami et al. | 381/86 |

FOREIGN PATENT DOCUMENTS

| | | | |
|---|---|---|---|
| CN | 1947171 | | 4/2007 |
| EP | 1544635 | A1 | 6/2005 |
| JP | S568994 | | 1/1981 |
| JP | S6139697 | | 2/1986 |
| JP | H0435300 | | 2/1992 |
| JP | H08286680 | | 11/1996 |
| JP | H11289592 | | 10/1999 |
| JP | 2005303574 | | 10/2005 |
| JP | 2008205896 | | 9/2008 |
| JP | 2010539590 | | 12/2010 |
| WO | WO2007037700 | A1 | 4/2007 |
| WO | WO2009035705 | A1 | 3/2009 |
| WO | WO2010149823 | A1 | 12/2010 |
| WO | WO2011010292 | | 1/2011 |
| WO | WO2011088053 | A2 | 7/2011 |

OTHER PUBLICATIONS

PCT Search Report dated Sep. 14, 2012 for PCT application No. PCT/US2012/043402, 7 pages.

Pinhanez, "The Everywhere Displays Projector: A Device to Create Ubiquitous Graphical Interfaces", IBM Thomas Watson Research Center, Ubicomp 2001, 18 pages.

Translated Japanese Office Action dated Mar. 3, 2015 for Japanese Patent Application No. 2014-517130, a counterpart foreign application of U.S. Appl. No. 13/165,620, 12 pages.

Partial Supplementary European Search Report dated Jun. 17, 2015 for European patent application No. 12803414.7, 7 pages.

Extended European Search Report dated Oct. 12, 2015 for European patent application No. 12803414.7, 11 pages.

Translated Japanese Office Action dated Feb. 2, 2016 for Japanese patent application No. 2014-517130, a counterpart foreign application of U.S. Appl. No. 13/165,620, 5 pages.

Translated Chinese Office Action dated Jul. 6, 2016 for Chinese patent application No. 201280031024.2, a counterpart foreign application of U.S. Appl. No. 13/165,620, 14 pages.

Translated Japanese Office Action dated Aug. 30, 2016 for Japanse patent application No. 2014-517130, a counterpart foreign application of U.S. Appl. No. 13/165,620, 4 pages.

Translated Chinese Office Action dated Mar. 27, 2017 for Chinese Patent Application No. 201280031024.2, a counterpart foreign application of U.S. Appl. No. 13/165,620, 25 pages.

Translated Chinese Office Action dated Sep. 25, 2017 for Chinese Patent Application No. 201280031024.2, a counterpart foreign application of U.S. Appl. No. 13/165,620, 24 pages.

European Office Action dated Jan. 3, 2018 for European patent application No. 12803414.7, a counterpart foreign application of U.S. Appl. No. 13/165,620, 5 pages.

* cited by examiner

900

BEAMFORMER COEFFICIENTS DATASTORE
126

| BEAM-PATTERN NAME 902 | AZIMUTH DIRECTION (DEGREES) 904 | ELEVATION DIRECTION (DEGREES) 906 | SIZE AND SHAPE 908 | BEAMFORMER COEFFICIENTS 910 |
|---|---|---|---|---|
| A | 0 | 30 | 6 lobe, ... | $A_1, A_2, A_3, A_4, \ldots, A_M$ |
| B | 270 | 30 | 6 lobe, ... | $B_1, B_2, B_3, B_4, \ldots, B_M$ |
| C | 135 | 30 | 6 lobe, ... | $C_1, C_2, C_3, C_4, \ldots, C_M$ |
| D | 0 | 45 | 8 lobe, ... | $D_1, D_2, D_3, D_4, \ldots, D_M$ |
| E | 90 | 45 | 6 lobe, ... | $E_1, E_2, E_3, E_4, \ldots, E_M$ |
| F | 90 | 30 | 8 lobe, ... | $F_1, F_2, F_3, F_4, \ldots, F_M$ |

⋮

FIG. 9

SIGNAL-ENHANCING BEAMFORMING IN AN AUGMENTED REALITY ENVIRONMENT

BACKGROUND

Augmented reality environments allow interaction among users and real-world objects and virtual or computer-generated objects and information. This merger between the real and virtual worlds paves the way for new interaction opportunities. However, acquiring data about these interactions, such as audio data including speech or audible gestures, may be impaired by noise or multiple signals present in the physical environment.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

FIG. 9 is an illustrative diagram of a beamformer coefficients datastore configured to store pre-calculated beamformer coefficients and associated data.

DETAILED DESCRIPTION

Figure 1:
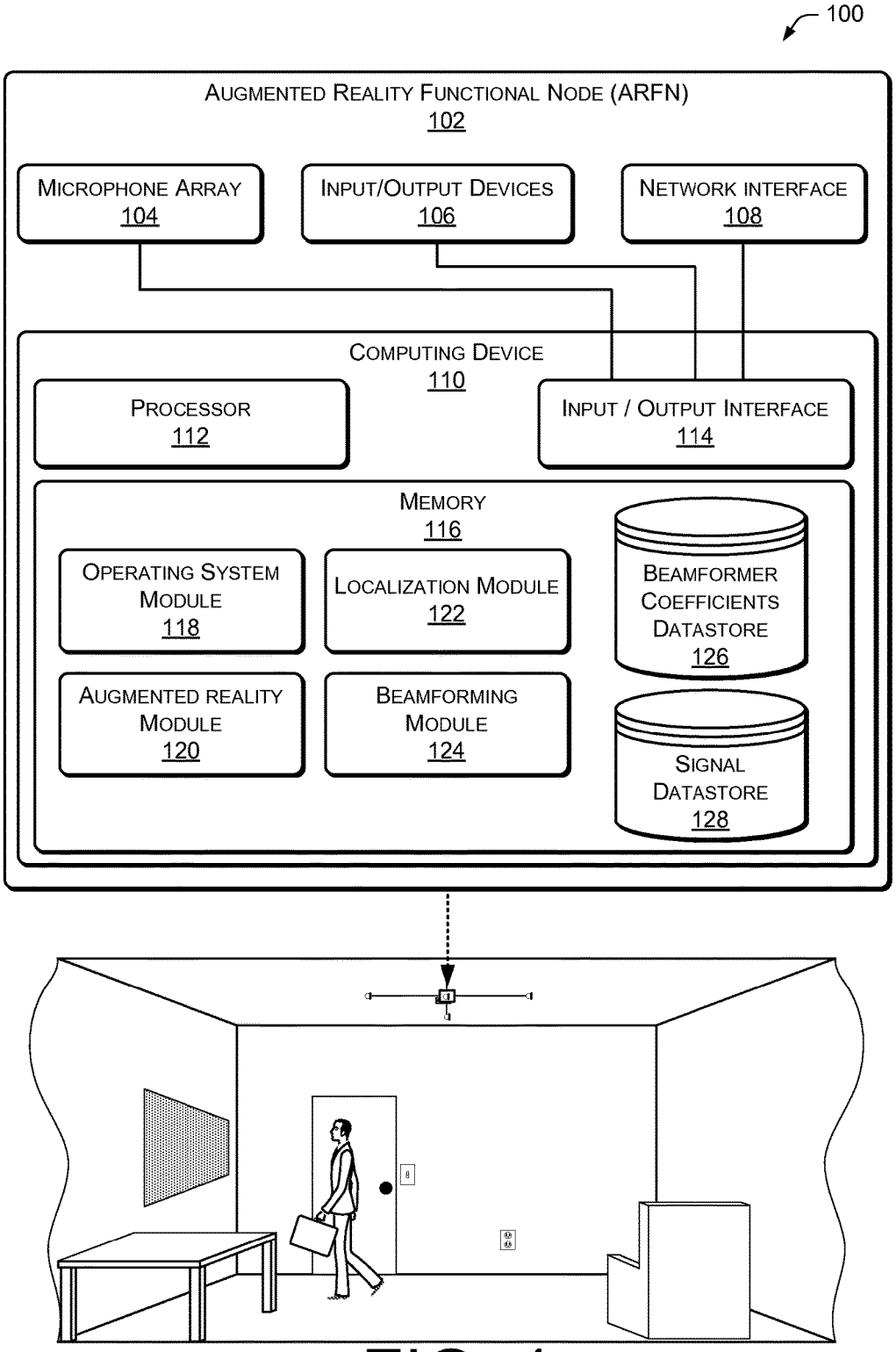
FIG. 1 shows an illustrative scene within an augmented reality environment which includes an augmented reality functional node and associated computing device with a beamforming module.

An augmented reality system may be configured to interact with objects within a scene and generate an augmented reality environment. The augmented reality environment allows for virtual objects and information to merge and interact with tangible real-world objects, and vice versa.

Disclosed herein are techniques and devices suitable for using an acoustic microphone array with beamforming to acquire or reject audio signals occurring within the physical environment of an augmented reality environment. Audio signals include useful information such as user speech, audible gestures, audio signaling devices, as well as noise sources such as street noise, mechanical systems, and so forth. The audio signals may include frequencies generally audible to the human ear or inaudible to the human ear, such as ultrasound.

Signal data is received from a plurality of microphones arranged in a microphone array. The microphones may be distributed in regular or irregular linear, planar, or three-dimensional arrangements. The signal data is then processed by a beamformer module to generate processed data. In some implementations the signal data may be stored for later processing.

Beamforming is the process of applying a set of beamformer coefficients to the signal data to create beampatterns, or effective volumes of gain or attenuation. In some implementations, these volumes may be considered to result from constructive and destructive interference between signals from individual microphones in the microphone array.

Application of the set of beamformer coefficients to the signal data results in processed data expressing the beampattern associated with those beamformer coefficients. Application of different beamformer coefficients to the signal data generates different processed data. Several different sets of beamformer coefficients may be applied to the signal data, resulting in a plurality of simultaneous beampatterns. Each of these beampatterns may have a different shape, direction, gain, and so forth.

Beamformer coefficients may be pre-calculated to generate beampatterns with particular characteristics. Such pre-calculation reduces overall computational demands. In other instances, meanwhile, the coefficients may be calculated on an on-demand basis. In either instance, the coefficients may be stored locally, remotely such as within cloud storage, or distributed across both.

A given beampattern may be used to selectively gather signals from a particular spatial location where a signal source is present. Localization data available within the augmented reality environment which describes the location of the signal source may be used to select a particular beampattern focused on that location. The signal source may be localized, that is have its spatial position determined, in the physical environment by various techniques including structured light, image capture, manual entry, trilateration of audio signals, and so forth. Structured light may involve projection of a pattern onto objects within a scene and may determine position based upon sensing the interaction of the objects with the pattern using an imaging device. The pattern may be regular, random, pseudo-random, and so forth. For example, a structured light system may determine a user's face is at particular coordinates within in the room.

The selected beampattern may be configured to provide gain or attenuation for the signal source. For example, the beampattern may be focused on a particular user's head allowing for the recovery of the user's speech while attenuating noise from an operating air conditioner across the MOM.

Such spatial selectivity by using beamforming allows for the rejection or attenuation of undesired signals outside of the beampattern. The increased selectivity of the beampattern improves signal-to-noise ratio for the audio signal. By improving the signal-to-noise ratio, the interpretation of audio signals within the augmented reality environment is improved.

The processed data from the beamformer module may then undergo additional filtering or be used directly by other modules. For example, a filter may be applied to processed data which is acquiring speech from a user to remove residual audio noise from a machine running in the environment.

The beamforming module may also be used to determine a direction or localize the audio signal source. This determination may be used to confirm a location determined in another fashion, such as from structured light, or when no initial location data is available. The direction of the signal source relative to the microphone array may be identified in a planar manner, such as with reference to an azimuth, or in a three-dimensional manner, such as with reference to an azimuth and an elevation. In some implementations the signal source may be localized with reference to a particular set of coordinates, such as azimuth, elevation, and distance from a known reference point.

Direction or localization may be determined by detecting a maximum signal among a plurality of beampatterns. Each of these beampatterns may have gain in different directions, have different shapes, and so forth. Given the characteristics such as beampattern direction, topology, size, relative gain, frequency response, and so forth, the direction and in some implementations location of a signal source may be determined.

ILLUSTRATIVE ENVIRONMENT

FIG. 1 shows an illustrative augmented reality environment 100 with an augmented reality functional node (ARFN) 102 with an associated computing device. In some implementations, additional ARFNs 102(1), 102(2), . . . , 102(N) may be used. The ARFN 102 may be positioned in the physical environment, such as in the corners or center of the ceiling, on a tabletop, on a floor stand, and so forth. When active, one such ARFN 102 may generate an augmented reality environment incorporating some or all of the items in the scene such as real-world objects.

A microphone array 104, input/output devices 106, network interface 108, and so forth may couple to a computing device 110 containing a processor 112 via an input/output interface 114. The microphone array 104 comprises a plurality of microphones. The microphones may be distributed in regular or irregular pattern. The pattern may be linear, planar, or three-dimensional. Microphones within the array may have different capabilities, patterns, and so forth. The microphone array 104 is discussed in more detail below with regards to FIGS. 3 and 4.

The ARFN 102 may incorporate or couple to input/output devices 106. These input/output devices include projectors, cameras, microphones, other ARFNs 102, other computing devices 110, and so forth. The coupling between the computing device 110 and the input/output devices 106 may be via wire, fiber optic cable, or wireless connection. Some of the input/output devices 106 of the ARFN 102 are described below in more detail with regards to FIG. 2.

The network interface 108 is configured to couple the computing device 110 to a network such as a local area network, wide area network, wireless wide area network, and so forth. For example, the network interface 108 may be used to transfer data between the computing device 110 and a cloud resource via the internet.

The processor 112 may comprise one or more processors configured to execute instructions. The instructions may be stored in memory 116, or in other memory accessible to the processor 112 such as in the cloud via the network interface 108.

The memory 116 may include computer-readable storage media ("CRSM"). The CRSM may be any available physical media accessible by a computing device to implement the instructions stored thereon. CRSM may include, but is not limited to, random access memory ("RAM"), read-only memory ("ROM"), electrically erasable programmable read-only memory ("EEPROM"), flash memory or other memory technology, compact disk read-only memory ("CD-ROM"), digital versatile disks ("DVD") or other optical disk storage, magnetic cassettes, magnetic tape, magnetic disk storage or other magnetic storage devices, or any other medium which can be used to store the desired information and which can be accessed by a computing device.

Several modules such as instructions, datastores, and so forth may be stored within the memory 116 and configured to execute on a processor, such as the processor 112. An operating system module 118 is configured to manage hardware and services within and coupled to the computing device 110 for the benefit of other modules. An augmented reality module 120 is configured to maintain the augmented reality environment.

A localization module 122 is configured to determine a location or direction of a signal source relative to the microphone array 104. The localization module 122 may utilize, at least in part, data including structured light, ranging data, and so forth as acquired via the input/output device 106 or the microphone array 104 to determine a location of the audio signal source. For example, a structured light projector and camera may be used to determine the physical location of the user's head, from which audible signals may emanate. In another example, audio time difference of arrival techniques may be used to determine the location.

A beamforming module 124 is configured to accept signal data from the microphone array 104 and apply beamformer coefficients to the signal data to generate processed data. By applying the beamformer coefficients to the signal data, a beampattern is formed which may exhibit gain, attenuation, directivity, and so forth. Such gain, attenuation, directivity and so forth is exhibited in the processed data. For example, the beampattern may focus and increase gain for speech coming from the user. By applying beamformer coefficients configured to produce a beampattern having gain focused on the user's physical location, the acquired signal may be improved in several ways. For example, the resulting processed data exhibits a speech signal with a greater signal-to-noise ratio compared to non-beamformer signals. In another example, the processed data may exhibit reduced noise from other spatial locations. In other implementations, other improvements may be exhibited. This increase in gain is discussed in more detail below with regards to FIG. 8.

Beamformer coefficients may be calculated on-the-fly, or at least a portion of the coefficients may be pre-calculated before use. The pre-calculated beamformer coefficients may be stored within a beamformer coefficients datastore 126, described in more depth below with regards to FIG. 9. In some implementations at least a portion of the beamformer coefficients datastore 126 may be located on external storage, such as in cloud storage accessible via the network interface 108.

In some implementations the signal data from the microphone array 104 and/or other input devices in the augmented reality environment may be stored in a signal datastore 128. For example, data about objects within the environment which generate audio signals may be stored, such as their size, shape, motion, and so forth. This stored data may be accessed for later processing by the beamforming module 124 or other modules.

Modules may be stored in the memory of the ARFN 102, storage devices accessible on the local network, or cloud storage accessible the network interface 108. For example, a dictation module may be stored and operated from within a cloud resource.

Figure 2:
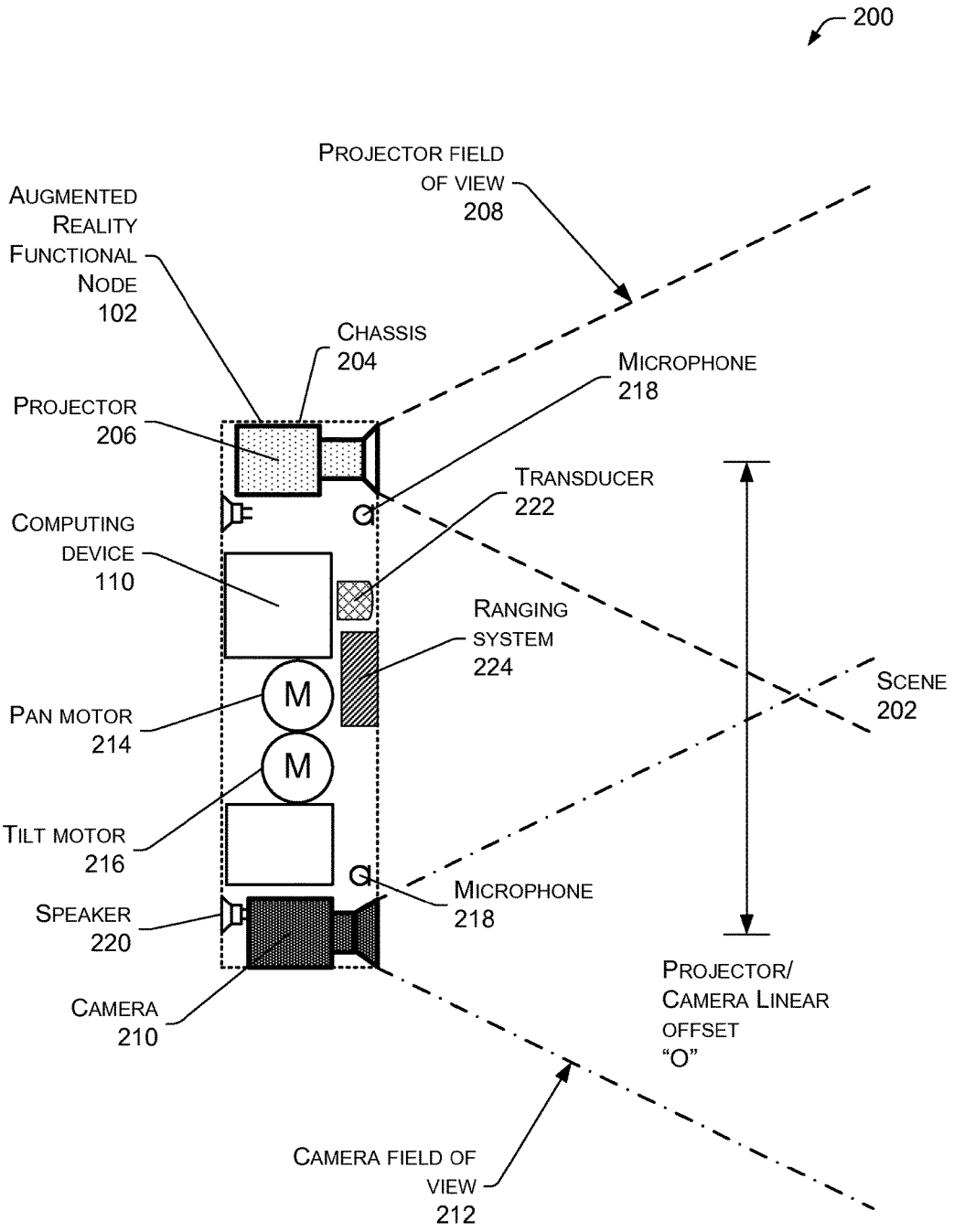
FIG. 2 shows an illustrative augmented reality functional node having a beamforming module along with other selected components.

FIG. 2 shows an illustrative schematic 200 of one example augmented reality functional node 102 and selected components including input/output devices 106. The ARFN 102 is configured to scan at least a portion of a scene 202 and the objects therein. The ARFN 102 may also be configured to provide augmented reality output, such as images, sounds, and so forth.

A chassis 204 holds the components of the ARFN 102. Within the chassis 204 may be disposed a projector 206 that generates and projects images into the scene 202. These images may be visible light images perceptible to the user, visible light images imperceptible to the user, images with non-visible light, or a combination thereof. This projector 206 may be implemented with any number of technologies capable of generating an image and projecting that image onto a surface within the environment. Suitable technologies include a digital micromirror device (DMD), liquid crystal on silicon display (LCOS), liquid crystal display, 3LCD, and so forth. The projector 206 has a projector field of view 208 which describes a particular solid angle. The projector field of view 208 may vary according to changes in the configuration of the projector. For example, the projector field of view 208 may narrow upon application of an optical zoom to the projector. In some implementations, a plurality of projectors 206 may be used.

A camera 210 may also be disposed within the chassis 204. The camera 210 is configured to image the scene in visible light wavelengths, non-visible light wavelengths, or both. The camera 210 has a camera field of view 212 which describes a particular solid angle. The camera field of view 212 may vary according to changes in the configuration of the camera 210. For example, an optical zoom of the camera may narrow the camera field of view 212. In some implementations, a plurality of cameras 210 may be used.

The chassis 204 may be mounted with a fixed orientation, or be coupled via an actuator to a fixture such that the chassis 204 may move. Actuators may include piezoelectric actuators, motors, linear actuators, and other devices configured to displace or move the chassis 204 or components therein such as the projector 206 and/or the camera 210. For example, in one implementation the actuator may comprise a pan motor 214, tilt motor 216, and so forth. The pan motor 214 is configured to rotate the chassis 204 in a yawing motion changing the azimuth. The tilt motor 216 is configured to change the pitch of the chassis 204 changing the elevation. By panning and/or tilting the chassis 204, different views of the scene may be acquired.

One or more microphones 218 may be disposed within the chassis 204, or elsewhere within the scene such in the microphone array 104. These microphones 218 may be used to acquire input from the user, for echolocation, location determination of a sound, or to otherwise aid in the characterization of and receipt of input from the scene. For example, the user may make a particular noise, such as a tap on a wall or snap of the fingers, which are pre-designated as attention command inputs. The user may alternatively use voice commands. In some implementations audio inputs may be located within the scene using time-of-arrival differences among the microphones, and/or with beamforming as described below with regards to FIG. 13-14.

One or more speakers 220 may also be present to provide for audible output. For example, the speakers 220 may be used to provide output from a text-to-speech module or to playback pre-recorded audio.

A transducer 222 may be present within the ARFN 102, or elsewhere within the environment, and configured to detect and/or generate inaudible signals, such as infrasound or ultrasound. These inaudible signals may be used to provide for signaling between accessory devices and the ARFN 102.

A ranging system 224 may also be provided in the ARFN 102. The ranging system 224 may be configured to provide distance, location, or distance and location information from the ARFN 102 to a scanned object or set of objects. The ranging system 224 may comprise radar, light detection and ranging (LIDAR), ultrasonic ranging, stereoscopic ranging, and so forth. The ranging system 224 may also provide direction information in some implementations. The transducer 222, the microphones 218, the speaker 220, or a combination thereof may be configured to use echolocation or echo-ranging to determine distance and spatial characteristics.

In another implementation, the ranging system 224 may comprise an acoustic transducer and the microphones 218 may be configured to detect a signal generated by the acoustic transducer. For example, a set of ultrasonic transducers may be disposed such that each projects ultrasonic sound into a particular sector of the room. The microphones 218 may be configured to receive the ultrasonic signals, or dedicated ultrasonic microphones may be used. Given the known location of the microphones relative to one another, active sonar ranging and positioning may be provided.

In this illustration, the computing device 110 is shown within the chassis 204. However, in other implementations all or a portion of the computing device 110 may be disposed in another location and coupled to the ARFN 102. This coupling may occur via wire, fiber optic cable, wirelessly, or a combination thereof. Furthermore, additional resources external to the ARFN 102 may be accessed, such as resources in another ARFN 102 accessible via the network interface 108 and a local area network, cloud resources accessible via a wide area network connection, or a combination thereof.

Also shown in this illustration is a projector/camera linear offset designated "O". This is a linear distance between the projector 206 and the camera 210. Placement of the projector 206 and the camera 210 at distance "O" from one another aids in the recovery of structured light data from the scene. The known projector/camera linear offset "O" may also be used to calculate distances, dimensioning, and otherwise aid in the characterization of objects within the scene 202. In other implementations the relative angle and size of the projector field of view 208 and camera field of view 212 may vary. Also, the angle of the projector 206 and the camera 210 relative to the chassis 204 may vary.

In other implementations, the components of the ARFN 102 may be distributed in one or more locations within the environment 100. As mentioned above, the microphones 218 and the speakers 220 may be distributed throughout the scene. The projector 206 and the camera 210 may also be located in separate chassis 204. The ARFN 102 may also include discrete portable signaling devices used by users to issue command attention inputs. For example, these may be acoustic clickers (audible or ultrasonic), electronic signaling devices such as infrared emitters, radio transmitters, and so forth.

Figure 3:
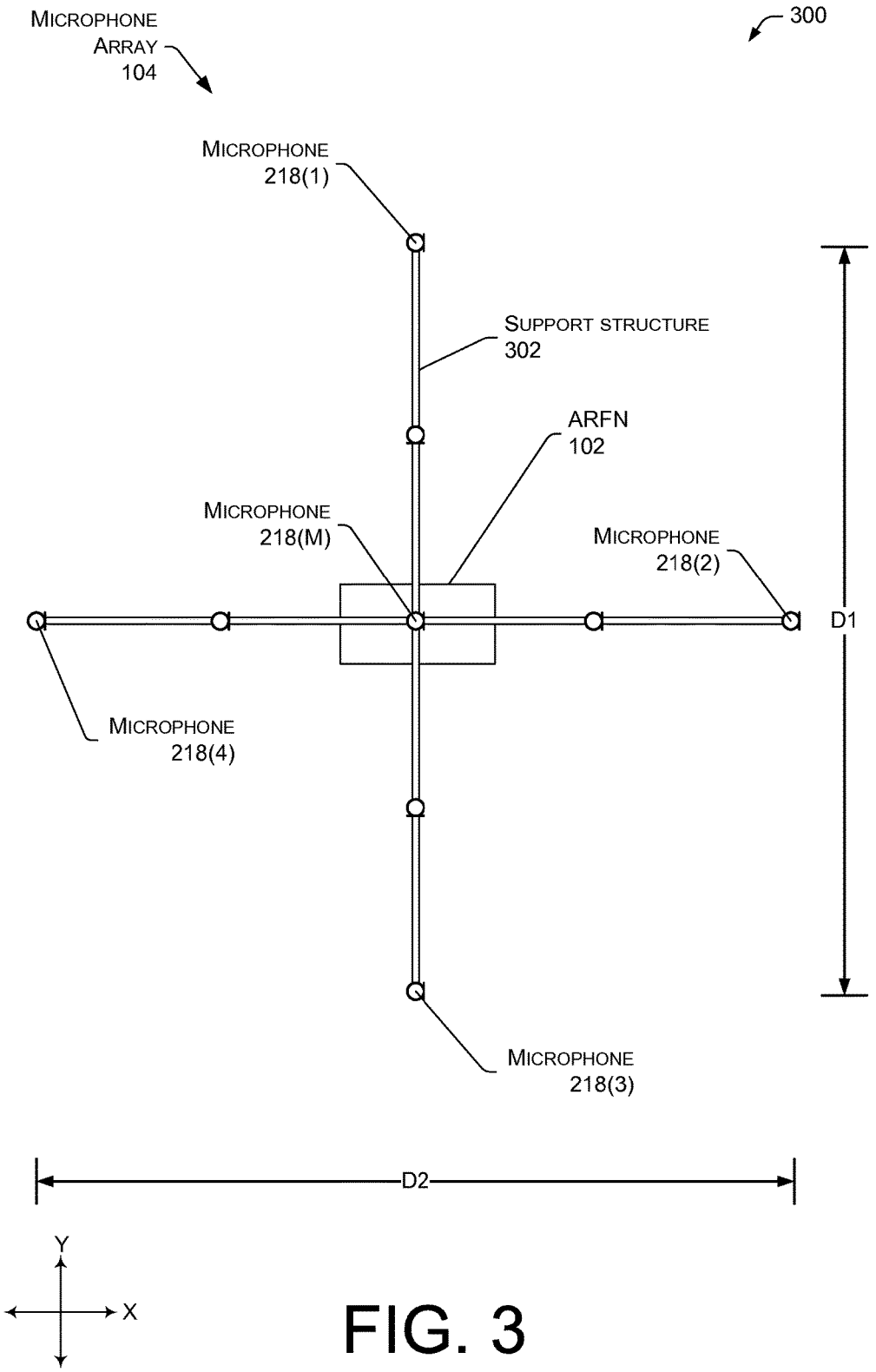
FIG. 3 shows an overhead view of a microphone array.
Figure 4:
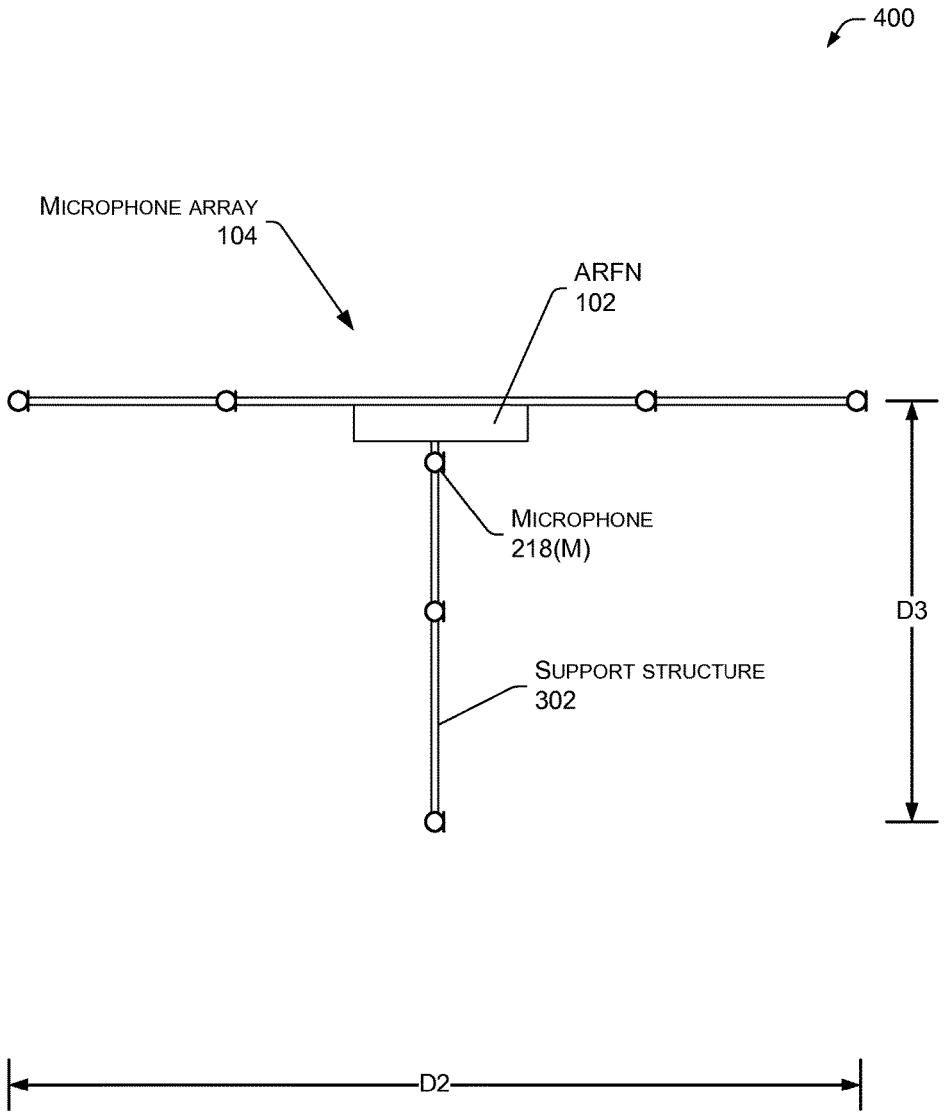
FIG. 4 shows a side view of the microphone array of FIG. 3.
Figure 4:
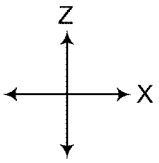

FIG. 3 shows an overhead view 300 of one implementation of the microphone array 104. In this illustration a support structure 302 describes a cross with two linear members disposed perpendicular to one another each having length of D1 and D2 and an orthogonal member as shown in FIG. 4 below. The support structure 302 aids in maintaining a known pre-determined distance between the microphones 218 which may then be used in the determination of the spatial coordinates of the acoustic signal.

Microphones 218(1)-(M) are distributed along the support structure 302. The distribution of the microphones 218 may be symmetrical or asymmetrical. It is understood that the number and placement of the microphones 218 as well as the shape of the support structure 302 may vary. For example, in other implementations the support structure may describe a triangular, circular, or another geometric shape. In some implementations an asymmetrical support structure shape, distribution of microphones, or both may be used.

The support structure 302 may comprise part of the structure of a room. For example, the microphones 218 may be mounted to the walls, ceilings, floor, and so forth within the room. In some implementations the microphones 218 may be emplaced, and their position relative to one another determined through other sensing means, such as via the ranging system 224, structured light scan, manual entry, and so forth. For example, in one implementation the microphones 218 may be placed at various locations within the room and their precise position relative to one another determined by the ranging system 224 using an optical range finder configured to detect an optical tag disposed upon each.

FIG. 4 shows a side view 400 of the microphone array of FIG. 3. As shown here, the microphone array 104 may be configured with the microphones 218 a three-dimensional arrangement. As shown here, a portion of the support structure is configured to be orthogonal to the other members of the support structure 302. The support structure 302 extends a distance D3 from the ARFN 102. By arranging the microphones 218 in a three-dimensional configuration, the beamforming module 124 may be configured to generate beampatterns directed to a particular azimuth and elevation relative to the microphone array 104.

In one implementation the microphones 218 and microphone array 104 are configured to operate in a non-aqueous and gaseous medium having a density of less than about 100 kilograms per cubic meter. For example, the microphone array 104 is configured to acquire audio signals in a standard atmosphere.

Figure 5:
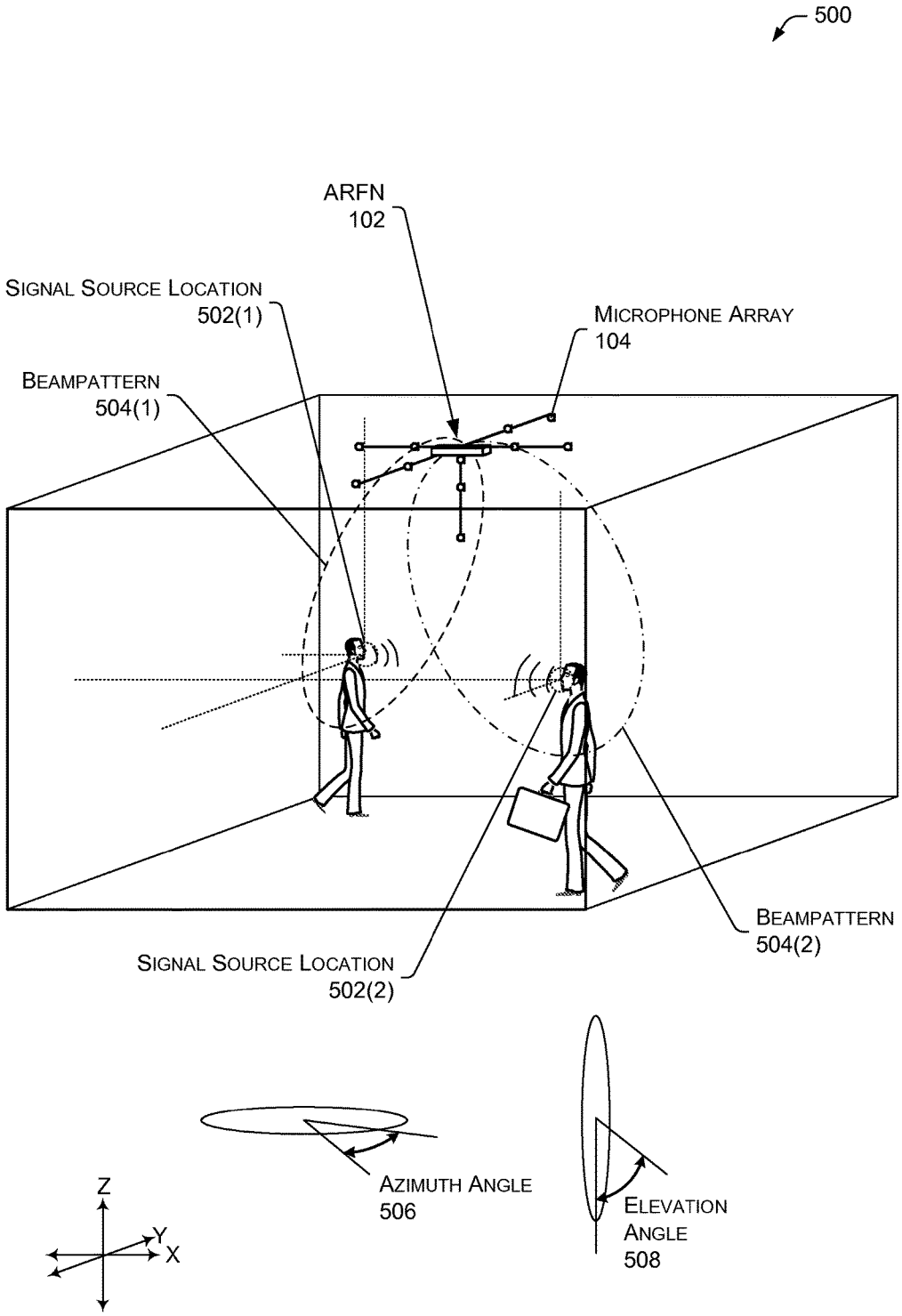
FIG. 5 illustrates a room containing multiple users with multiple simultaneous beampatterns configured to acquire audio signals from the multiple users.

FIG. 5 illustrates a room 500 containing multiple users in an augmented reality environment as provided by the ARFN 102 and the microphone array 104. As shown, the two users are at opposing corners of the room, each of whom is speaking in the illustration. In addition, the room may have other sound sources such as refrigerator, air conditioner, and so forth. Speech from the first user is shown at signal source location 502(1). Similarly, speech from the second user across the room is shown at signal source location 502(2). The beamforming module 124 simultaneously generates a pair of beampatterns 504(1) and 504(2). The beampattern 504(1) is focused on the signal source location 502(1) while the beampattern 504(2) is focused on the signal source location 502(2). By focusing the respective beampatterns and their resulting gain on the individual users, the acquired speech signal in the processed data exhibits an increased signal-to-noise ratio while the sound from the other user's speech is attenuated or eliminated. This results in a cleaner signal improving results in downstream processing, such as speech recognition of the processed data.

The direction to a signal source may be designated in three-dimensional space with an azimuth and elevation angle. The azimuth angle 506 indicates an angular displacement relative to an origin. The elevation angle 508 indicates an angular displacement relative to an origin, such as local vertical.

Beamforming Techniques

Figure 6:
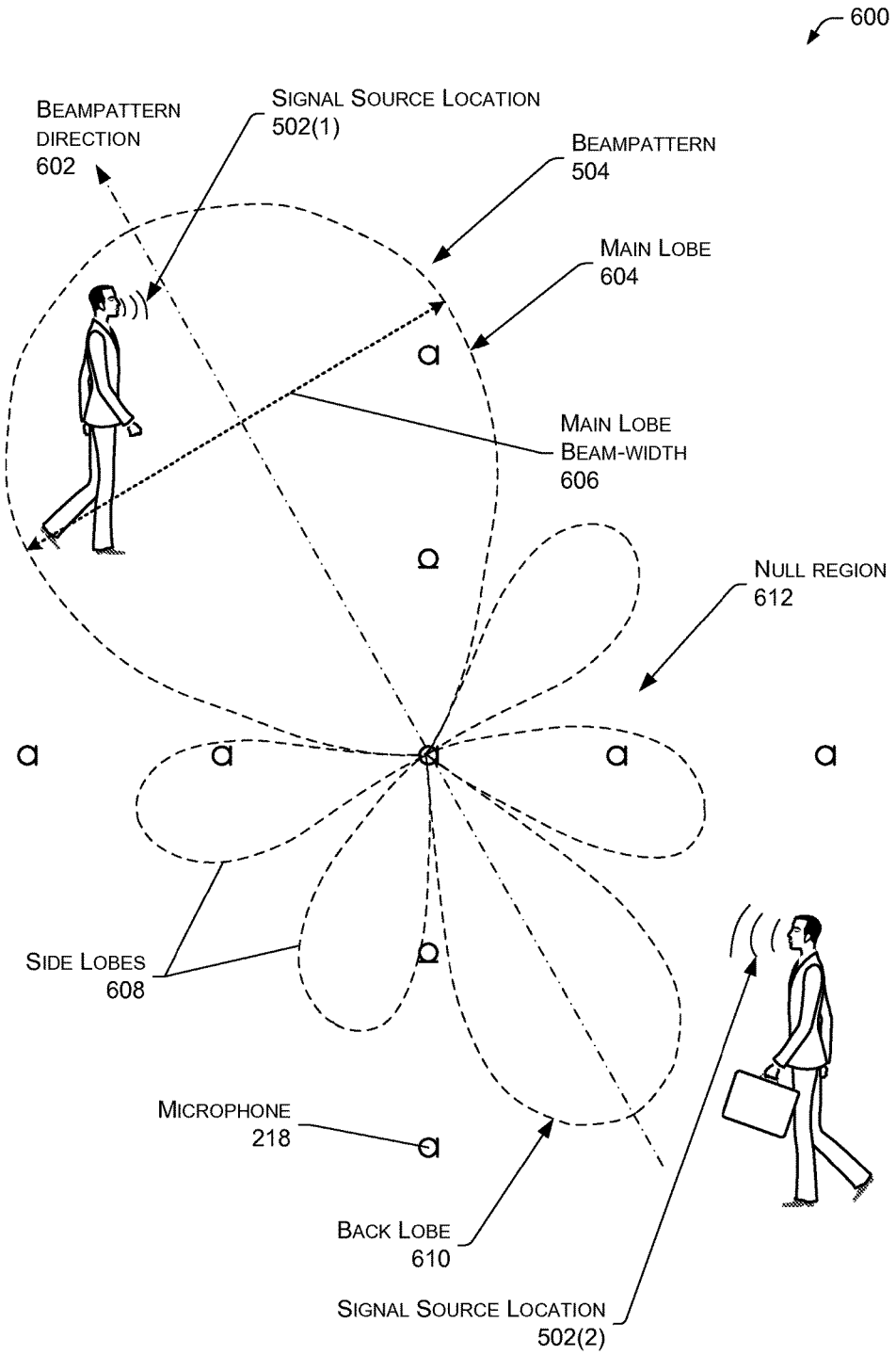
FIG. 6 illustrates a schematic of a beampattern formed by applying beamforming coefficients to signal data acquired from the microphone array.

FIG. 6 illustrates a schematic 600 of a beampattern 504 formed by applying beamforming coefficients to signal data acquired from the microphone array 104. As mentioned above, the beampattern results from the application of a set of beamformer coefficients to the signal data. The beampattern generates volumes of effective gain or attenuation. In this illustration, the dashed line indicates isometric lines of gain provided by the beamforming coefficients. For example, the gain at the dashed line here may be +12 decibels (dB) relative to an isotropic microphone.

The beampattern 504 may exhibit a plurality of lobes, or regions of gain, with gain predominating in a particular direction designated the beampattern direction 602. A main lobe 604 is shown here extending along the beampattern direction 602. A main lobe beam-width 606 is shown, indicating a maximum width of the main lobe 604. A plurality of side lobes 608 is also shown. Opposite the main lobe 604 along the beampattern direction 602 is the back lobe 610. Disposed around the beampattern 504 are null regions 612. These null regions are areas of attenuation to signals. For example, as shown here the signal source location 502(1) of the first speaker is within the main lobe 604 and benefits from the gain provided by the beampattern 504 and exhibits improved a signal-to-noise ratio compared to a signal acquired with non-beamforming. In contrast, the signal source location 502(2) of the second speaker is in a null region 612 behind the back lobe 610. As a result the signal from the signal source location 502(2) is significantly reduced relative to the first signal source location 502(1).

As shown in this illustration, the use of the beampatterns provides for gain in signal acquisition compared to non-beamforming. Beamforming also allows for spatial selectivity, effectively allowing the system to "turn a deaf ear" on a signal which is not of interest. Furthermore, because multiple beampatterns may be applied simultaneously to the same set of signal data from the microphone array 104, it is possible to have multiple simultaneous beampatterns. For example, a second beampattern 504(2) may be generated simultaneously allowing for gain and signal rejection specific to the signal source location 502(2), as discussed in more depth below with regards to FIG. 10.

Figure 7:
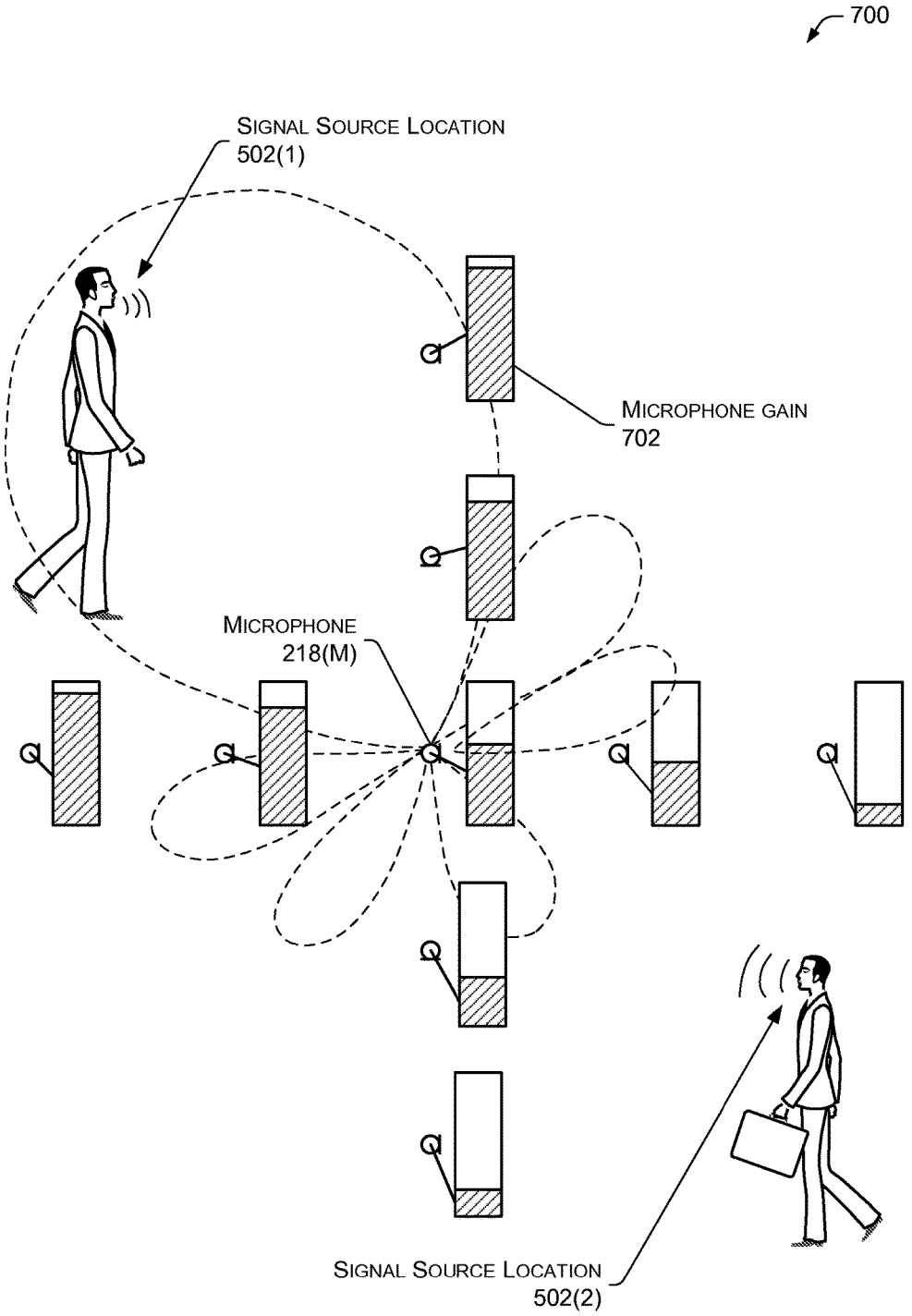
FIG. 7 illustrates a schematic of a beampattern formed by applying beamforming coefficients to signals acquired from the microphone array when gain of at least a portion of the microphones in the array has been adjusted.

FIG. 7 illustrates a schematic 700 of a beampattern formed by applying beamforming coefficients to signals acquired from the microphone array 104 when gain of at least a portion of the microphones in the array has been varied. Gain for each of the microphones 218 in the microphone array 104 may be varied globally across each of the microphones 218, across a group of microphone 218, or for an individual microphone 218. The microphone gain change may occur in the microphone hardware 218, may be applied using signal processing techniques, or a combination thereof. Furthermore, adjustment of the gain may be dynamic and thus adjusted over time.

As shown here, our two signal source locations 502(1) and 502(2) from the first and second users respectively are present in the single room. In this example, assume the second user is a loud talker, producing a high-amplitude audio signal at the signal source location 502(2). The use of the beampattern 504 shown here which is focused on the first user provides gain for the signal source location 502(1) of the first speaker while attenuating the second speaker at the second signal source location 502(2). However, consider that even with this attenuation resulting from the beampattern, the second user is such a loud talker that his speech continues to interfere with the speech signal from the first user.

To alleviate this situation, or provide other benefits, gain to the microphones 218 may be applied differentially across the microphone array 104. In this illustration, a graph of microphone gain 702 is shown associated with each microphone 218 in the array 104. As shown here, gain is reduced in the microphones 218 closest to the second signal source location 502(2). This reduces the signal input from the second user, minimizing the signal amplitude of their speech captured by the beampattern. Similarly, the gain of the microphones 218 proximate to the first speaker's first signal source location 502(1) are increased to provide greater signal amplitude.

In other implementations depending upon microphone response, position of the speaker, and so forth, the gain of the individual microphones may be varied to produce a beampattern which is focused on the signal source location of interest. For example, in some implementations signal-to-noise ratio may be improved by decreasing gain of a microphone proximate to the signal source location of interest.

Figure 8:
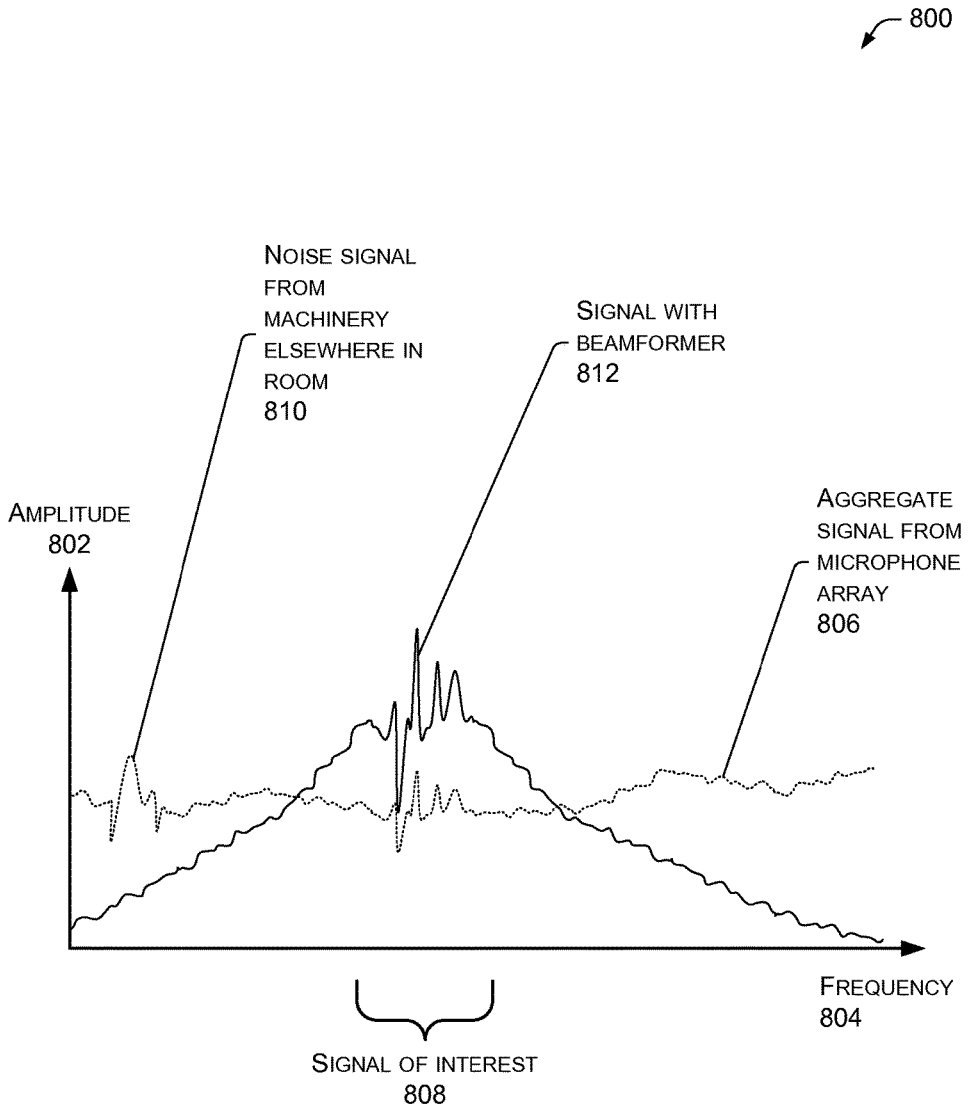
FIG. 8 is a graph illustrating improvement in signal acquisition when using beamforming as compared to non-beamforming.

FIG. 8 is an example graph 800 illustrating the improvement in signal recovery when using beamforming as compared to non-beamforming. Amplitude 802 is indicates along a vertical axis, while frequency 804 of a signal is indicated along a horizontal axis.

Shown here with a dotted line is an aggregate signal 806 from the microphone array 104 without beamforming applied. In the aggregate signal 806, the signal of interest 808 shows an amplitude comparable to the noise the signal. A noise signal from machinery such as an air conditioner operating elsewhere in the room 810 is shown here. Attempting to analyze the signal 808, such as processing for speech recognition would likely result in poor results given the low signal-to-noise ratio.

In contrast, the signal with the beamformer 812 clearly elevates the signal of interest 808 well above the noise. Furthermore, the spatial selectivity of the signal with beamformer 812 has effectively eliminated the machinery noise 810 from the signal. As a result of the improved signal quality, additional analysis of the signal such as for speech recognition experiences improved results.

FIG. 9 is an illustrative diagram 900 of the beamformer coefficients datastore 126. The beamformer coefficients datastore 126 is configured to store pre-calculated or on-the-fly beamformer coefficients. The beamformer coefficient may be considered a form of weighting applied to a signal from each of the microphones 218 in the microphone array 104. As described above, by applying a particular set of beamformer coefficients, a particular beampattern may be obtained.

The beamformer coefficients datastore 126 may be configured to store a beampattern name 902, as well as the directionality of the beampattern 504. This directionality may be designated for one or more lobes of the beampattern 504, relative to the physical arrangement of the microphone array 104. For illustration only and not by way of limitation, the directionality of the beampattern is the beampattern direction 602, that is the direction of the main lobe 604.

The directionality may include the azimuth direction 904 and elevation direction 906, along with size and shape 908 of the beampattern. For example, beampattern A is directed in an azimuth of 0 degrees and an elevation of 30 degrees, and has six lobes. In other implementations, size and extent of each of the lobes may be specified. Other characteristics of the beampattern such as beampattern direction, topology, size, relative gain, frequency response, and so forth may also be stored.

Beamformer coefficients 910 which generate each beampattern are stored in the beamformer coefficients datastore 126. When applied to signal data which includes signals from the microphones 218(M) to generate processed data, these coefficients act to weigh or modify those signals to generate a particular beampattern.

The beamformer coefficients datastore 126 may store one or more beampatterns. For example, beampatterns having gain in different directions may be stored. By pre-computing, storing, and retrieving coefficients computational demands are reduced compared to calculation of the beamformer coefficients during processing. As described above, in some implementations one portion of the beamformer coefficients datastore 126 may be stored within the memory 116, while another portion may be stored in cloud resources.

Figure 10:
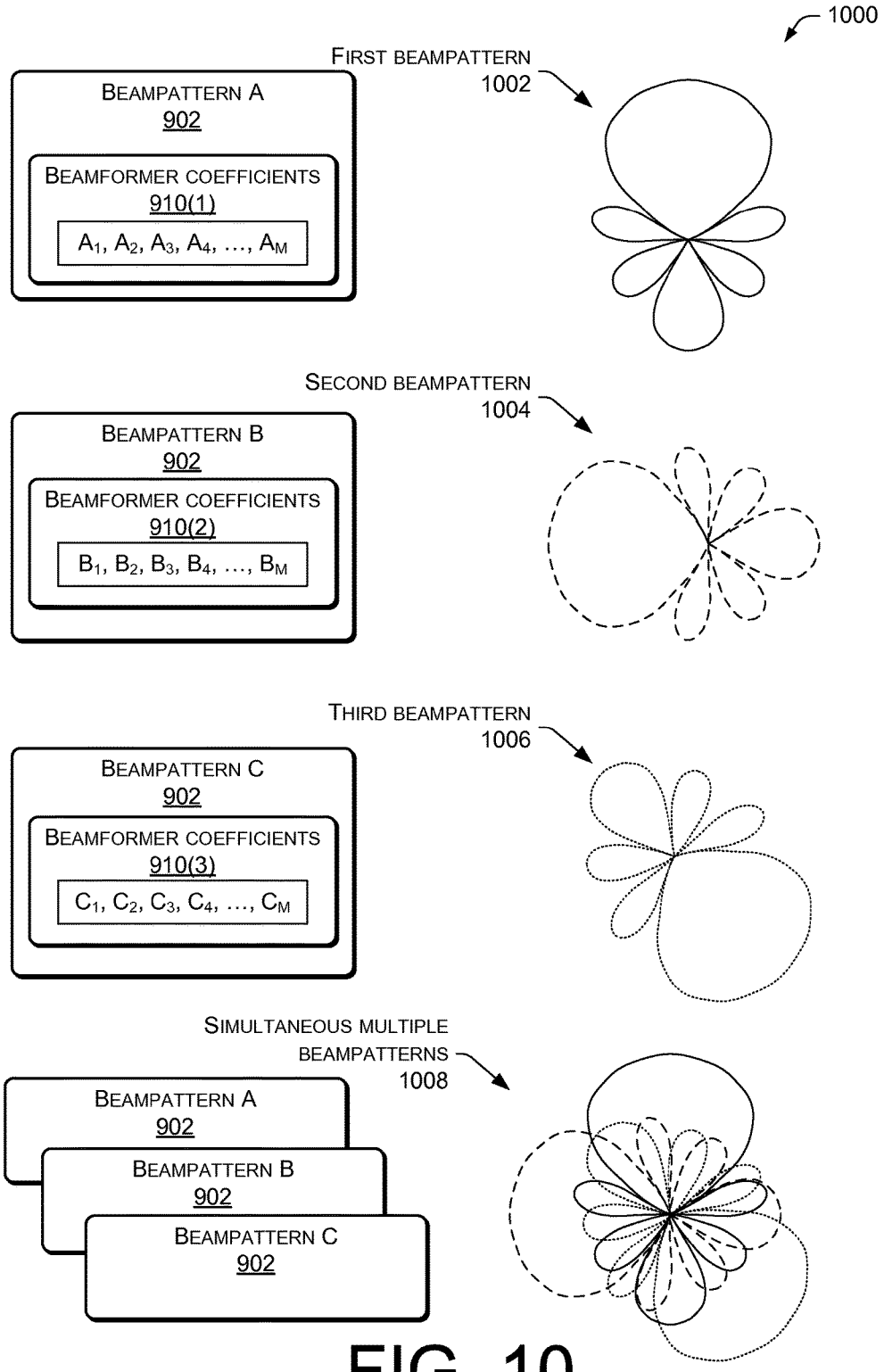
FIG. 10 illustrates a plurality of different beampatterns resulting from different beamformer coefficients and their simultaneous use.

FIG. 10 illustrates a plurality of different beampatterns 1000 resulting from different beamformer coefficients and their simultaneous use. Because the beampatterns are data constructs producing specific processed data, it is possible to generate a plurality of different beampatterns simultaneously from the same set of signal data.

As shown here, a first beampattern 1002 is shown as generated by application beampattern A 902 having beamformer coefficients 910(1). A second beampattern 1004 having gain in a different direction and resulting from beampattern B 902 is also shown. A third beampattern 1006 resulting from application of beampattern C's 902 beamformer coefficients 910(3) points in a direction different from the first and second beampatterns.

As shown at 1008, all three or more beampatterns may be simultaneously active. Thus, as shown in this example, three separate signal sources may be tracked, each with a different beampattern with associated beamformer coefficients. So long as the beamforming module 124 has access to computational capacity to process the incoming signal data from the microphone 104, additional beampatterns may be generated.

Figure 11:
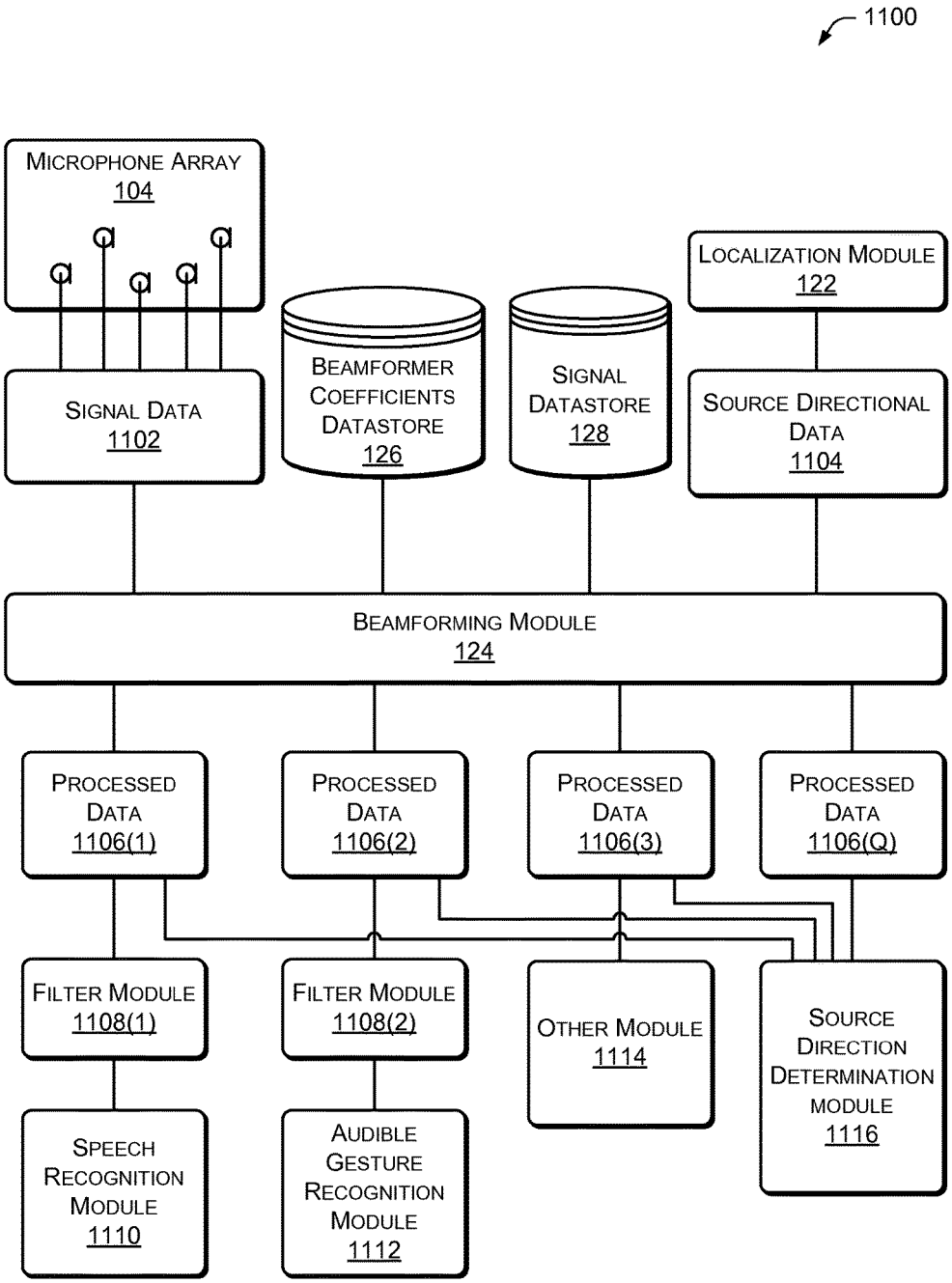
FIG. 11 illustrates interactions with the beamforming module.

FIG. 11 illustrates the beamforming module 124 and its interactions. The microphone array 104 generates signal data 1102. This signal data 1102 includes data from at least a portion of the microphones in the array 104. For example, in some implementations some microphones 218 may be disabled and thus not produce data. The signal data 1102 is provided to the beamforming module 124.

The localization module 122 may provide source directional data 1104 to the beamforming module 124. For example, the localization module 122 may use structured light to determine the signal source location 502 of the user is at certain spatial coordinates. The source directional data 1104 may comprise spatial coordinates, an azimuth, an elevation, or an azimuth and elevation relative to the microphone array 104.

The beamforming module 124 may generate or select a set of beamformer coefficients 910 from the beamformer coefficients datastore 126. The selection of the beamformer coefficients 910 and their corresponding beampatterns 504 may be determined based at least in part upon the source directional data 1104 for the signal source. The selection may be made to provide gain or attenuation to a given signal source. For example, beamformer coefficients 910 resulting in the beampattern 504 which provides gain to the user's speech while attenuating spatially distinct noise sources may be selected. As described above, the beamformer coefficients 910 may be pre-calculated at least in part.

The beamforming module 124 applies one or more sets of beamformer coefficients 910 to the signal data 1102 to generate processed data 1106. For example and not by way of limitation, the beamforming module 124 may use four sets of beamformer coefficients 910(1)-(4) and generate four sets of processed data 1106(1)-(4). While originating from the same signal data, each of these sets of processed data 1106 may be distinct due to their different beampatterns 504.

The processed data may be analyzed or further manipulated by additional processes. At shown here, the processed data 1106(1) is filtered by filter module 1108(1). The filtered processed data 1106(1) is then provided to a speech recognition module 1110. The filter module 1108(1) may comprise a band-pass filter configured to selectively pass frequencies of human speech. The filter modules herein may be analog, digital, or a combination thereof. The speech recognition module 110 is configured to analyze the processed data 1106 which may or may not be filtered by the filter module 1108(1) and recognize human speech as input to the augmented reality environment.

The second set of processed data 1106(2) may or may not be processed by a second filter module 1108(2) and provided to an audible gesture recognition module 1112 for analysis. The audible gesture recognition module 1112 may be configured to determine audible gestures such as claps, finger-snaps, tapping, and so forth as input to the augmented reality environment.

So long as the beamforming module 124 has access to processing capability to apply beamforming coefficients 910 to the signal data 1102, multiple simultaneous beampatterns may be produced, each with processed data output. The third set of processed data 1106(3) such as generated by a third set of beamformer coefficients 910 may be provided to some other module 1114. The other module 1114 may provide other functions such as audio recording, biometric monitoring, and so forth.

In some implementations the source directional data 1104 may be unavailable, unreliable, or it may be desirable to confirm the source directional data independently. The ability to selectively generate beampatterns simultaneously may be used to localize a sound source.

A source direction determination module 1116 may be configured as shown to accept multiple processed data inputs 1106(1), . . . 1106(Q). Using a series of different beampatterns 504, the system may search for signal strength maximums. By using successively finer resolution beampatterns 504, the source direction determination module 116 may be configured to isolate a direction to the signal source, relative to the microphone array 104. In some implementations the signal source may be localized to a particular region in space. For example, a set of beampatterns each having different origin points may be configured to triangulate the signal source location, as discussed in more detail below with regards to FIGS. 13-14.

The beamforming module 124 may also be configured to track a signal source. This tracking may include modification of pre-calculated set of beamformer coefficients 910, or the successive selection of different sets of beamformer coefficients 910.

The beamforming module 124 may operate in real-time, near-real-time, or may be applied to previously acquired and stored data such as in the signal datastore 128. For example, consider a presentation which took place in the augmented reality environment. The signal data 1102 from the presentation was stored in the signal datastore 128. During the presentation by a presenter, two colleagues in the back of the room conversed with one another, discussing a point raised by the presenter. Upon request for a recording of their side conversation, the beamforming module 124 uses one or more beampatterns to focus on the signal from their position in the room during the conversation and generate processed data 1106 of their conversation. In contrast, other users requesting playback of the presentation may hear audio resulting from beampatterns focused on the presenter.

Illustrative Processes

The processes described in this disclosure may be implemented by the architectures described herein, or by other architectures. These processes are illustrated as a collection of blocks in a logical flow graph. Some of the blocks represent operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order or in parallel to implement the processes. It is understood that the following processes may be implemented on other architectures as well.

Figure 12:
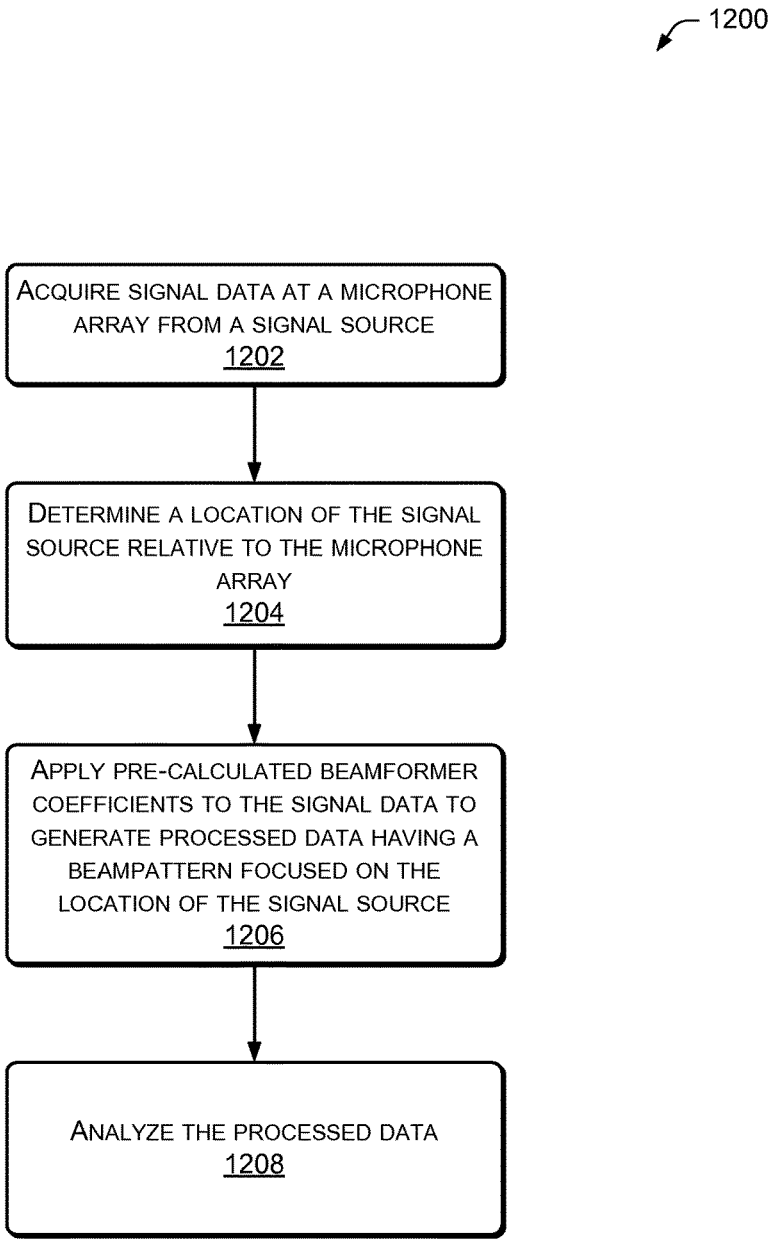
FIG. 12 is an illustrative process of acquiring a signal using a beamformer when direction to a signal source is known.

FIG. 12 is an illustrative process 1200 of acquiring a signal using a beamformer when direction of the signal source is known. At 1202, signal data is acquired at the microphone array 104 from a signal source. For example, the microphone array 104 may detect the sound of a user's speech in the augmented reality environment.

At 1204, a location of the signal source relative to the microphone array 104 is determined. Continuing the example, the ARFN 102 may use structured light from the projector 206 and received by the camera 210 to determine the source directional data 1104 showing the user is located at spatial coordinates X, Y, Z in the room, which is at a relative azimuth of 300 degrees and elevation of 45 degrees relative to the microphone array 104.

At 1206, a set of beamformer coefficients 910 are applied to the signal data to generate processed data 1106 having a beampattern 504 focused on the location or the direction of the signal source. In some implementations, at least a portion of the beamformer coefficients 910 may be pre-calculated and retrieved from the beamformer coefficients datastore 126. Selection of the set of beamformer coefficients 910 may be determined at least in part by resolution of the source directional data 1104. For example, where the source directional data has a margin of error of ±1 meter, a beampattern having a larger main lobe beam-width 606 may be selected over a beampattern having a smaller main lobe beam-width 606 to insure capture of the signal.

At 1208, the processed data 1106 may be analyzed. For example, the processed data may be analyzed by the speech recognition module 1110, audible gesture recognition module 1112, and so forth. Continuing the example, the speech recognition module 1110 may generate text data from the user's speech. Likewise, the audible gesture recognitions module 1112 may determine a hand clap has taken place and produce this as a user input.

In some implementations the set of beamformer coefficients 910 may be updated at least partly in response to changes in the determined location or direction of the signal source. For example, where the signal source is a user speaking while walking, the set of beamformer coefficients 910 applied to the signal data 1102 may be successively updated to provide a primary lobe with gain focused on the user while in motion.

While a single signal and beampattern have been described here, it is understood that multiple signals may be acquired and multiple simultaneous beampatterns may be present.

Figure 13:
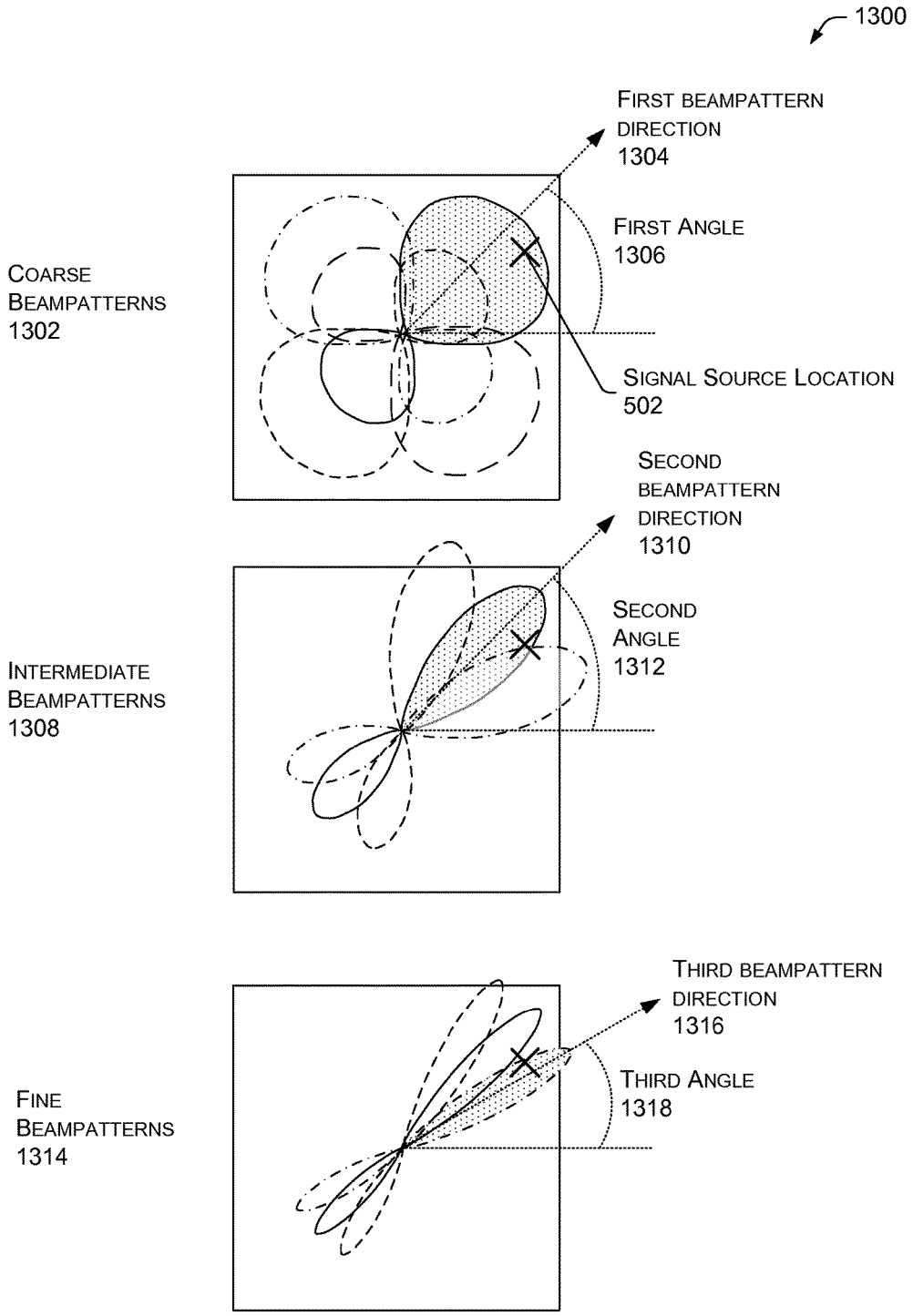
FIG. 13 illustrates use of a beamformer generating beampatterns having successively finer spatial characteristics to determine a direction to a signal source.

FIG. 13 illustrates 1300 using a beamformer generating beampatterns having successively finer spatial characteristics to determine a direction to a signal source. As mentioned above, in some implementations it may be desired to use the signal data 1102 from the microphone array 104 to determine a location or direction to an audible signal source.

Shown here is a room with a set of four coarse beampatterns 1302 deployed therein. These beampatterns 504 are configured to cover four quadrants of the room. As mentioned above, these beampatterns 504 may be exist simultaneously. The signal source location 502 is indicated with an "X" in the upper right quadrant of the room. The processed data 1106 from each of the beampatterns 504 may be compared to determine in which of the beampatterns a signal maximum is present. For example, the beamforming module 124 may determine which beampattern has the loudest signal.

As shown here, the beampattern 504 having a main lobe and beamdirection to the upper right quadrant is shaded, indicating it is the beampattern which contains the maximum signal. A first beampattern direction 1304 is shown at a first angle 1306. Because the coarse beampatterns 1302 are relatively large, at this point the direction to the signal source location 502 is imprecise.

Based upon the determination that the upper right beampattern contains the signal maximum, a set of intermediate beampatterns 1308 is then applied to the signal data 1102. As shown here, this set of intermediate beampatterns are contained predominately within the volume of upper right quadrant of interest, each having smaller primary lobes than the coarse beampatterns 1302. A signal maximum is determined from among the intermediate beampatterns 1308, and as shown here by the shaded primary lobe having a second beampattern direction 1310 at a second angle 1312.

A succession of beampatterns having different gain, orientation, and so forth may continue to be applied to the signal data 1102 to refine the signal source location 502. As shown here, a set of fine beampatterns 1314 are focused around the second beampattern direction 1310. Again, from these beampatterns a signal maximum is detected. For example, as shown here, the shaded lobe of one of the fine beampatterns 1314 contains the signal maximum. A third beampattern direction 1316 of this beampattern is shown having a third angle 1318. The direction to the signal source location 502 may thus be determined as the third angle 1318.

Figure 14:
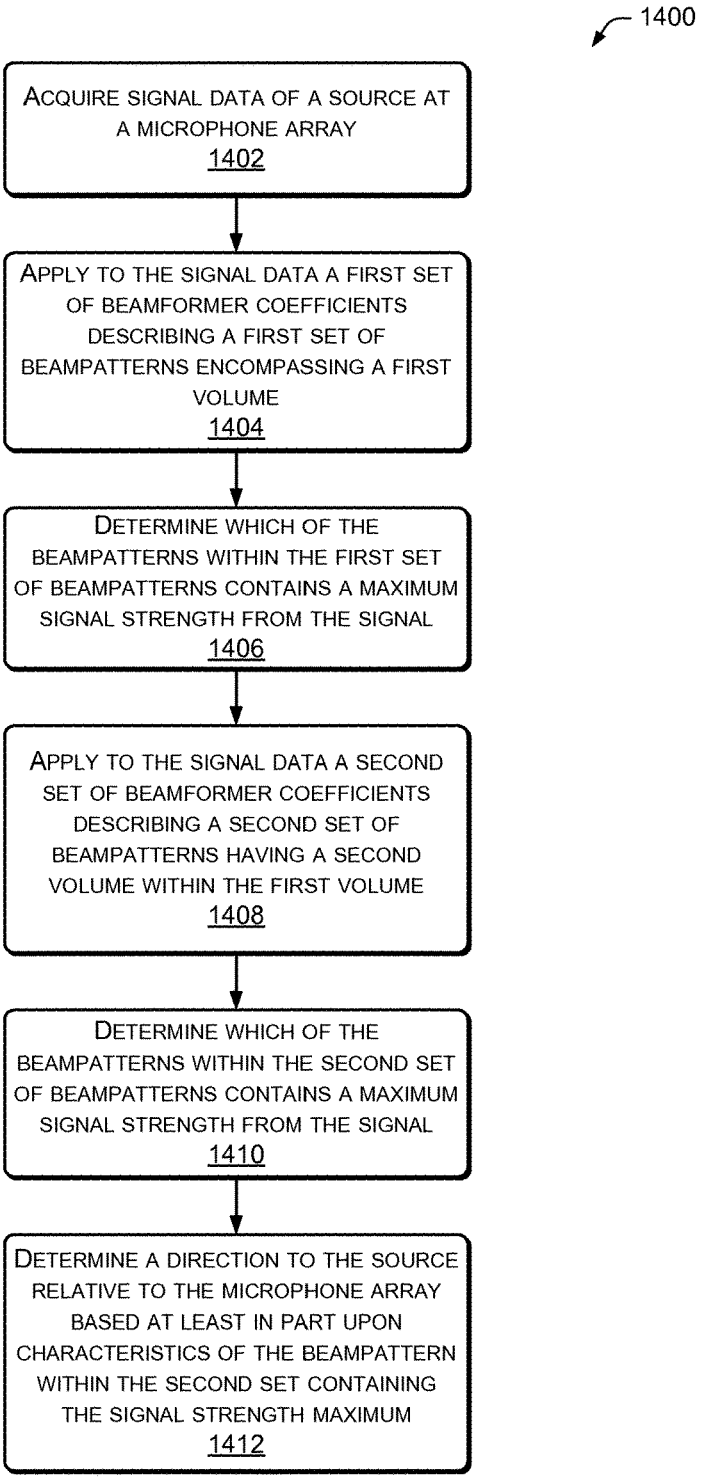
FIG. 14 is an illustrative process of determining a direction to a signal source based at least in part upon acquisition of signals with a beamformer.

FIG. 14 is an illustrative process 1400 of determining a direction to a signal source based at least in part upon acquisition of signals with a beamformer. At 1402, the signal data 1102 is acquired at the microphone array 104 from a signal source. For example, the microphone array 104 may detect the sound of a user clapping in the augmented reality environment.

At 1404, a first set of beamformer coefficients 910 describing a first set of beampatterns 504 encompassing a first volume is applied to the signal data 1102. For example, the coarse beampatterns 1302 of FIG. 13 may be applied to the signal data 1102.

At 1406, a determination is made as to which of the beampatterns within the first set of beampatterns contains a maximum signal strength from the signal. Continuing the example from FIG. 13, the selection of the beampattern having the first beampattern direction 1304.

At 1408, a second set of beamformer coefficients 910 describing a second set of beampatterns within the first volume is applied to the signal data 1102. For example, the intermediate beampatterns 1308 within the upper right quadrant. In some implementations the beampatterns in the second set may extend outside the first volume. However, the beampatterns in the second set of beamformer coefficients 910 may be configured to be disposed predominately within the first volume.

At 1410, a determination is made as to which of the beampatterns within the second set of beampatterns contains a maximum signal strength from the signal. For example, the beampattern having the second beampattern direction 1310.

At 1412, a direction to the source relative to the microphone array 104 is determined based at least in part upon the characteristics of the beampattern within the second set containing the signal strength maximum. The characteristics of the beampattern may include the beampattern direction 602, main-lobe beamwidth 606, gain pattern, beampattern geometry, location of null regions 612, and so forth.

In some implementations additional iterations of successively finer beampatterns may be used to further refine the direction to the signal source. Furthermore, in some implementations the beampatterns may be configured to have origins disposed in different physical locations. The origin of the beampattern is the central point about which the lobes may be considered to extend from.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. An augmented reality system comprising:

a processor;

a microphone array comprising a plurality of microphones coupled to the processor, a first microphone of the plurality of microphones configured to generate first signal data from a first audio signal source and a second microphone of the plurality of microphones configured to generate second signal data from a second audio signal source;

a projector coupled to the processor and configured to generate structured light;

a camera coupled to the processor and configured to receive the structured light;

a beamformer coefficient datastore configured to store a set of beamformer coefficients, individual beamformer coefficients of the set of beamformer coefficients being associated with a different beampattern of one or more beampatterns; and one or more computer-executable instructions that are executable by the processor to:

determine a first location of the first audio signal source and a second location of the second audio signal source;

select a first set of beamformer coefficients from the beamformer coefficient datastore based at least in part upon the first location of the first audio signal source and first directional data associated with the first audio signal source, the first set of beamformer coefficients corresponding to a first beampattern of the one or more beampatterns; and select a second set of beamformer coefficients from the beamformer coefficient datastore based at least in part upon the second location of the second audio signal source and second directional data associated with the second audio signal source, the second set of beamformer coefficients corresponding to a second beampattern of the one or more beampatterns, the first beampattern causing an attenuation of noise output by the second audio signal source based at least in part on a distance between the first location and the second location.

2. The system of claim 1, wherein each of the one or more beampatterns includes a main lobe, and wherein the one or more computer-executable instructions are further executable by the processor to select the first beampattern by placing the first location of the first audio signal source within a main lobe of the first beampattern.

3. The system of claim 1, wherein each of the one or more beampatterns includes a null region, and wherein the one or more computer-executable instructions are further executable by the processor to select the first beampattern by placing the first location of the first audio signal source in a null region of the first beampattern.

4. The system of claim 1, wherein the one or more computer-executable instructions are further executable by the processor to select the first beampattern by determining that a main lobe beamwidth is proportionate to an accuracy of the first location of the first audio signal source.

5. The system of claim 1, wherein the plurality of microphones are configured to be placed in a planar arrangement when operational.

6. The system of claim 1, wherein the plurality of microphones are configured to be placed in a three-dimensional arrangement when operational.

7. The system of claim 1, wherein the one or more computer-executable instructions are further executable by the processor to apply the first set of beamformer coefficients associated with first beampattern to the first signal data to generate processed data.

8. The system of claim 7, wherein the one or more computer-executable instructions are further executable by the processor to filter the processed data.

9. The system of claim 7, wherein the one or more computer-executable instructions are further executable by the processor to determine an audible gesture based at least in part on the processed data.

10. The system of claim 1, further comprising a signal datastore configured to store signal data for processing.

11. One or more non-transitory computer-readable media storing computer-executable instructions that, when executed, cause one or more processors to perform acts comprising:

acquiring, at a first microphone of a microphone array, first signal data from a first signal source;

acquiring, at a second microphone of the microphone array, second signal data from a second signal source;

determining a first location of the first signal source and a second location of the second signal source;

selecting a first set of beamformer coefficients based at least in part upon the first location of the first signal source and first directional data associated with the first signal source, the first set of beamformer coefficients corresponding to a first beampattern; and selecting a second set of beamformer coefficients based at least in part upon the second location of the second signal source and second directional data associated with the second signal source, the second set of beamformer coefficients corresponding to a second beampattern, the first beampattern causing an attenuation of at least one of noise or echo output by the second signal source based at least in part on a distance between the first location and the second location.

12. The one or more non-transitory computer-readable storage media of claim 11, wherein at least one of the first set of beamformer coefficients or the second set of beamformer coefficients are calculated prior to acquiring at least one of the first signal data or the second signal data.

13. The one or more non-transitory computer-readable storage media of claim 11, the acts further comprising:

determining an imprecise direction of at least one of the first signal source or the second signal source relative to the microphone array; and generating processed data based at least in part on application of at least one of the first set of beamformer coefficients or the second set of beamformer coefficients.

14. The one or more non-transitory computer-readable storage media of claim 13, the acts further comprising analyzing the processed data.

15. The one or more non-transitory computer-readable storage media of claim 14, the analyzing comprising recognizing speech in the processed data.

16. The one or more non-transitory computer-readable storage media of claim 14, the analyzing comprising recognizing an audible gesture in the processed data.

17. The one or more non-transitory computer-readable storage media of claim 11, the acts further comprising selectively adjusting gain of at least one of the first microphone or the second microphone.

18. The one or more non-transitory computer-readable storage media of claim 17, wherein selectively adjusting the gain comprises altering analog gain of at least one of the first microphone or the second microphone.

19. One or more non-transitory computer-readable media storing computer-executable instructions that, when executed, cause one or more processors to perform acts comprising:

acquiring first signal data of a first signal source from a first microphone of a microphone array;

acquiring second signal data of a second signal source from a second microphone of the microphone array;

determining a first location of the first signal source and a second location of the second audio signal source;

selecting a first set of beamformer coefficients based at least in part upon the first location of the first signal source and first directional data associated with the first signal source, the first set of beamformer coefficients corresponding to a first beampattern;

selecting a second set of beamformer coefficients based at least in part upon the second location of the second signal source and second directional data associated with the second signal source, the second set of beamformer coefficients corresponding to a second beampattern;

applying, to the first signal data, the first set of beamformer coefficients; and applying, to the second signal data, the second set of beamformer coefficients, at least one of the first beampattern or the second beampattern causing at least one of an attenuation or an elimination of noise associated with the second signal data.

20. The one or more non-transitory computer-readable storage media of claim 19, the acts further comprising determining one or more characteristics of the at least one of the first beampattern or the second beampattern, the one or more characteristics being associated with at least one of beampattern direction, topology, size, relative gain, or frequency response.

21. The one or more non-transitory computer-readable storage media of claim 19, the acts further comprising applying the first set of beamformer coefficients to the first signal data and applying the second set of beamformer coefficients to the second signal data in parallel.

22. The one or more non-transitory computer-readable storage media of claim 19, wherein the first beampattern encompasses a first volume.

23. The one or more non-transitory computer-readable storage media of claim 22, wherein the second beampattern encompasses a second volume that is disposed predominantly within the first volume.

24. The one or more non-transitory computer-readable storage media of claim 19, the acts further comprising:

determining that the first beampattern contains a first maximum signal strength from the first signal data as compared to first other beampatterns of a first set of beampatterns associated with the first signal data; and determining that the second beampattern contains a second maximum signal strength from the second signal data as compared to second other beampatterns of a second set of beampatterns associated with the second signal data.

* * * * *